US008516771B2

(12) United States Patent
Mang, Sr. et al.

(10) Patent No.: US 8,516,771 B2
(45) Date of Patent: Aug. 27, 2013

(54) METHOD OF REFACING A STAIRCASE

(75) Inventors: Bruce R. Mang, Sr., Richfield Springs, NY (US); Steven H. Mott, Gettysburg, PA (US); Douglas P. Plourde, Waterville, NY (US); Norman J. Plourde, Valatie, NY (US)

(73) Assignee: Ideal Wood Products, Inc., Little Falls, NY (US)

( * ) Notice: Subject to any disclaimer, the term of this patent is extended or adjusted under 35 U.S.C. 154(b) by 247 days.

(21) Appl. No.: 12/850,660

(22) Filed: Aug. 5, 2010

(65) Prior Publication Data

US 2012/0210671 A1 Aug. 23, 2012

Related U.S. Application Data

(60) Provisional application No. 61/231,774, filed on Aug. 6, 2009.

(51) Int. Cl.
*E04B 1/00* (2006.01)

(52) U.S. Cl.
USPC ..... 52/741.2; 52/182; 52/188; 52/190

(58) Field of Classification Search
USPC ..... 52/741.2, 182, 183, 188, 190, 191, 52/184
See application file for complete search history.

(56) References Cited

U.S. PATENT DOCUMENTS

| | | | | |
|---|---|---|---|---|
| 569,464 | A * | 10/1896 | Pr | 52/188 |
| 3,393,481 | A * | 7/1968 | Meuret | 52/188 |
| 4,783,939 | A * | 11/1988 | Bergmann et al. | 52/188 |
| 6,115,975 | A | 9/2000 | Abdollahi | |
| 6,397,529 | B1 * | 6/2002 | Grenier | 52/182 |
| 6,665,987 | B2 | 12/2003 | Eve et al. | |
| 6,960,273 | B2 | 11/2005 | Jung | |
| 7,464,505 | B2 * | 12/2008 | Grenier | 52/179 |
| 8,033,063 | B2 * | 10/2011 | Won | 52/188 |
| 8,141,321 | B2 * | 3/2012 | Young | 52/741.2 |
| 2007/0028534 | A1 | 2/2007 | Defehr et al. | |
| 2008/0271390 | A1 | 11/2008 | Lopez | |

* cited by examiner

*Primary Examiner* — Chi Q Nguyen
(74) *Attorney, Agent, or Firm* — Hooker & Habib, P.C.

(57) ABSTRACT

A method of refacing a staircase having original treads and original risers with replacement treads and replacement risers is disclosed. Each replacement tread overhangs a respective original riser by a distance greater than the thickness of the replacement riser. The replacement riser is shimmed and spaced from the original riser a distance equal to the difference between the replacement riser thickness and the overhang distance. Preferably the replacement treads overhang the replacement risers the same distance that the original treads overhang the original risers.

11 Claims, 1 Drawing Sheet

METHOD OF REFACING A STAIRCASE

FIELD OF THE DISCLOSURE

The disclosure relates generally to the field of staircases, and in particular, to a method of renovating or refacing an existing staircase.

BACKGROUND OF THE DISCLOSURE

A conventional residential staircase includes horizontal step treads and vertical risers extending vertically between the treads.

Renovating an old residential staircase is conventionally done in one of two ways:

(1) the old staircase is removed, and a new staircase constructed in place, or (2) new treads are placed over the existing treads.

Option (1) is expensive, and requires skilled labor familiar with staircase construction.

Option (2) often results in a staircase that does not comply with building codes. The new tread alters the rise/run or the tread depth of the staircase such that the modified staircase is no longer in code compliance.

Most staircases are built with stairs in which the tread overhangs the riser at the front of the tread. The overhang is typically between three-quarters of an inch and one and one-half inches in residential construction. Often the overhanging portion of the tread is cut off when installing new tread over the existing tread, adding to labor cost and requiring cleanup of sawdust and cuttings.

Known methods of refacing a residential staircase have other disadvantages.

Jung, U.S. Pat. No. 6,960,272 discloses a method wherein a replacement tread is placed on and overhangs the old tread. A replacement riser fits in a bottom groove formed in the overhanging portion of the replacement tread and then bends back to be supported against the old riser and against the bottom of the next lower old tread. The construction is relatively expensive and so is not practical for refacing. Fasteners installed from the upper side of the replacement tread are visible.

Abdollahi, U.S. Pat. No. 6,115,975 discloses a stair system that might be adaptable to refacing an existing staircase. The vertically spaced ends of a replacement riser is captured in grooves or dadoes formed in the upper replacement tread and a lower back molding supported on the lower replacement tread. The construction is relatively complicated and so is not practical for refacing. The back molding is visible, impairing the smooth transition between the lower replacement tread and the replacement riser.

Lopez, US Patent Application Publication 20080271390 discloses an apparatus for refacing an existing staircase. The apparatus includes a replacement tread, a nosing on the front end of the replacement tread, and a replacement riser attached to the nosing and extending from the bottom side of the replacement tread near the front end of the tread. The replacement riser is spaced a fixed distance from the front end of the replacement tread, which may change the tread depth of the stairs after refacing. The change in tread depth may cause the refaced stairs to go out of code. Having the replacement tread and replacement riser formed as an integral piece also makes the apparatus bulky to transport and handle. Installation on uneven floors can be difficult.

Defahr et al., US Patent Application Publication 20070028534 discloses a stair system that might be adaptable to refacing an existing staircase. A replacement tread plate has a nosing member faces and covers the front edge of an existing tread. A replacement riser is attached to and bears directly against the original riser below the original tread. The replacement riser extends between the top of the next lower replacement tread and the bottom of the existing tread. Defahr et al. however, does not recognize that placing the replacement riser against the original riser affects the resulting rise/run of the refaced staircase.

Thus there is a need for an improved method of renovating or refacing a staircase to avoid the disadvantages of the prior art methods.

BRIEF SUMMARY OF THE DISCLOSURE

Disclosed is an improved method of renovating or refacing a staircase. The method does not require removing the old staircase, does not require skilled labor and could even be successfully carried out by "do-it-yourselfers", and keeps the staircase in compliance with building codes. The component parts are easy to transport, handle, and install.

The method of refacing the staircase includes the steps of:

(a) installing a replacement tread over the existing tread of the staircase;

(b) installing a replacement riser against the existing riser extending above the existing tread.

The replacement tread preferably overhangs the existing, original tread the same distance that the original tread overhangs the original riser.

The replacement riser extends from the replacement tread and preferably has the same thickness (typically three-quarters of an inch) as the tread overhang at the top of the replacement riser. The installed replacement riser is then flush with the overhanging tread. Repeat for each step, preferably working from the bottom of the stairs and up the stairs to the upper landing floor. Finish by installing a replacement tread on the upper landing floor.

Preferably the replacement treads have a thickness of ¾ inch. Many staircase renovations are undertaken because new hardwood flooring is installed on the bottom landing floor. Hardwood flooring is conventionally three-quarters of an inch thick and the new flooring raises the elevation of the lower landing floor by the thickness of the flooring. Using a tread thickness the same thickness as the hardwood floor keeps the rise/run of the refaced staircase the same as the original.

If the staircase is refaced without changing the lower landing floor, the thickness of the replacement tread at the first step next to the lower landing floor and at the upper landing floor is preferably relatively thin, preferably about three-eighths of an inch. Using a relatively thin tread at these two end locations of the staircase will keep the rise/run of the staircase in compliance with building codes.

If the tread overhang of the original staircase is greater than three-quarters of an inch, the replacement riser can be shimmed against the original riser to be flush with the tread overhang. This maintains the same tread depth as the original tread.

Preferably the replacement tread has a nosing and a scotia that overhangs the original tread and extends downwardly beyond the upper end of the adjacent replacement riser. This covers the joint between the replacement riser and the overhanging original tread for added support of the riser and provides a desirable ornamental effect. Preferably the replacement tread and the nosing scotia are preformed as an integral piece and are prefinished for ease of handling and installation.

The replacement treads and risers are preferably cut to appropriate lengths equal to the stair width of the staircase prior to beginning installation. These cuts can be made outdoors to keep the house interior clean.

The disclosed stair refacing method has a number of advantages as recited above. It can also be useful for new construction. Often staircases are manufactured off-site and then installed while the house is partially complete. Construction workers and equipment going up and down the staircase will damage the staircase. Instead, the staircase manufacture can manufacture the staircase frame off-site and workers and equipment can then use the staircase frame. The disclosed method can be used to reface the tread and risers of the staircase frame with finished hardwood risers and treads to complete the finished staircase after home construction is essentially complete.

Other objects and features will become evident as the description proceeds, especially when taken in conjunction with the accompanying two drawing sheets.

DESCRIPTION OF THE PREFERRED EMBODIMENT

Figures 1, 2:
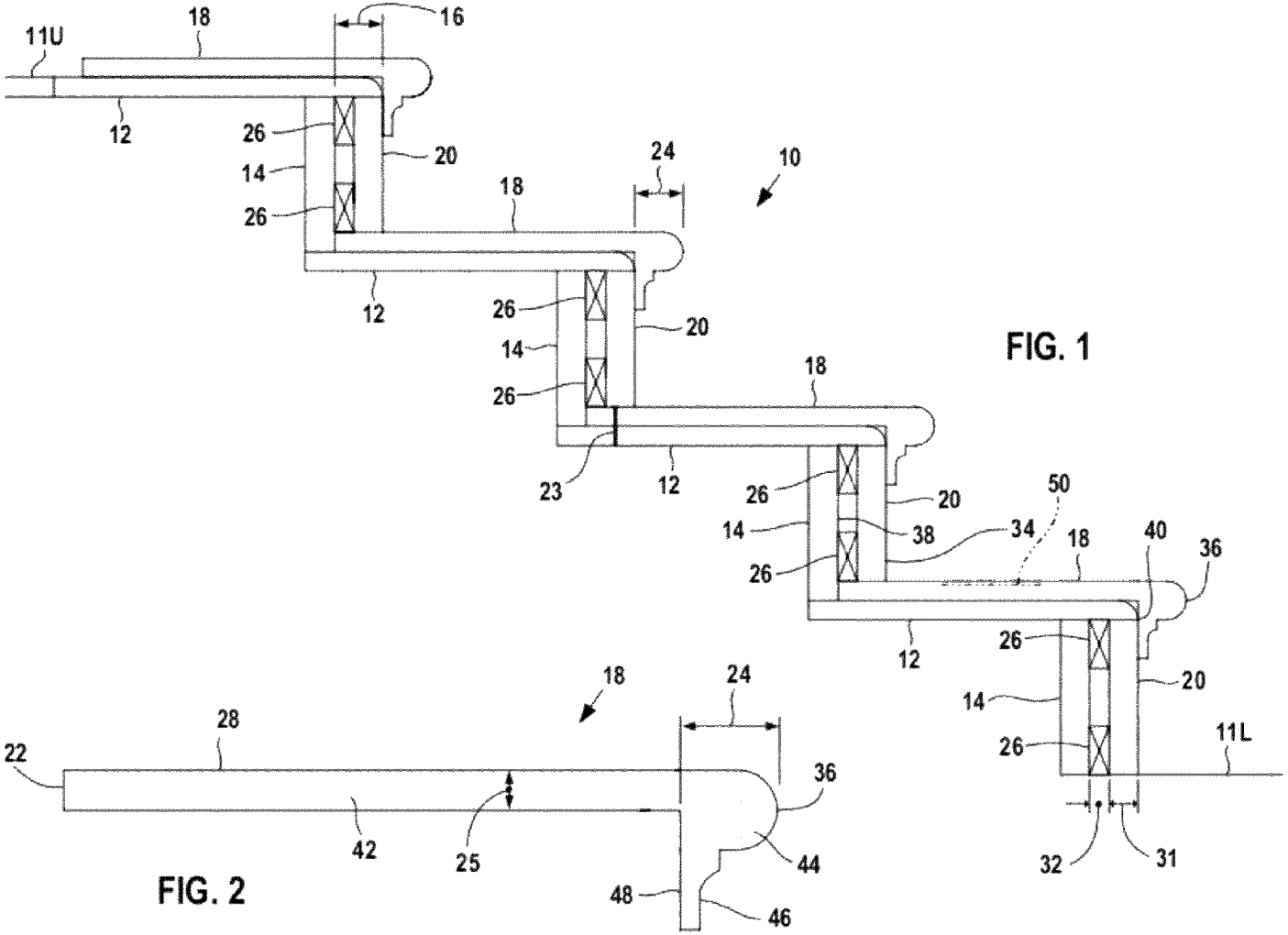
FIG. 1 is a side view of a staircase refaced in accordance with an embodiment of the disclosed method.
FIG. 2 is a side view of a replacement tread used in refacing the staircase shown in FIG. 1.

FIG. 1 illustrates a refaced residential staircase 10. Any previously applied carpeting or additional flooring materials were removed from the staircase prior to refacing. The staircase extends between a lower landing 11L and an upper landing 11U, and includes a number of original treads 12 and original risers 14. In the illustrated embodiment each tread 12 overhangs a riser 14 by a distance 16 of one inch.

The staircase 10 has been refaced using a number of like replacement treads 18 and like replacement risers 20. FIG. 2 is an enlarged view of a single replacement tread 18.

Each replacement tread 18 is placed on and supported on a respective original tread 12. The back end 22 of the replacement tread 18 butts against the original riser 14 with the replacement tread 18 overhanging the original tread 12 by a distance 24 of one inch, that is, the replacement tread 18 overhangs the original tread 12 by the same distance the original tread 12 overhangs the original riser 14. Industrial adhesive is preferably used between the replacement tread 22 and the original tread 12. The back edge of the replacement tread 18 can be nailed or otherwise through-fastened to the original tread by fasteners 23. Note that the nails or fasteners 23 being placed sufficiently towards the back edge of the replacement tread 18 are hidden by the replacement riser 20 and will not be visible when installation is completed.

The replacement treads 18 preferably have equal thickness dimensions 25 to maintain the same rise between steps, but the tread thicknesses of the uppermost and lowermost replacement treads can vary within code allowances to accommodate the transition from the landing to the stairs. For example, the lowermost replacement tread 18 may be relatively less thick to reduce the rise between it and the original lower landing 11L. FIG. 1 illustrates with the phantom line 50 the top surface of a thinner tread 18 that may be used to transition from the landing 11L to the stairs.

The illustrated replacement risers 20 are each attached to a respective original riser 14 but are spaced from the riser 14 by respective sets of shims 26 placed between the original and replacement risers 14, 20. The illustrated embodiment employs a pair of shims 26 to space a replacement riser 20 away from an original riser 14: a lower shim 26 against the lower replacement tread plate 18 and an upper shim 26 against the upper original tread plate 12. Each replacement riser 20 extends vertically from the upper surface 28 of the adjacent lower replacement tread (except that the lowest riser 14 extends vertically from the lower level 11L) to the lower surface 30 of the adjacent upper replacement tread 20.

In the illustrated embodiment the replacement risers 20 each has a thickness dimension 31 of about three-quarters of an inch, that is, the thickness of the replacement risers 20 is less than the overhang distance 24. The shims 26 each have a respective thickness dimension 32 of one-quarter inch, equal to the difference between the overhang distance 24 and the riser thickness 30. The shims 26 locate the outer surface 34 of the replacement riser 20 the same distance from the front end 36 of an adjacent lower tread 18 as the outer surface 38 of the adjacent original riser 14 is from the front end 40 of an adjacent lower original tread 12. The resulting tread depth (distance from the front end of the tread to the back riser) of the replacement tread 18 is the same as the tread depth of the original tread 12 before refacing.

FIG. 2 illustrates a preferred embodiment of the replacement tread 18. The replacement tread 18 includes a flat, horizontal tread plate 42, a decorative nosing 44, and a scotia 46. The scotia 46 has a vertical inner exposed surface or face that is perpendicular to the tread plate 42 and is spaced inwardly from the front end of the tread 18 the overhang distance 24. Upon installation, the scotia 46 is located immediately next to the adjacent lower replacement riser 20 and partially overlays the lower replacement riser 20 to hide the seam between the tread 18 and the lower replacement riser 20.

The replacement treads 18 are preferably manufactured to be a one-piece, pre-finished member to save time at the construction site.

The preferred method of refacing the original staircase 10 in which the thickness of the replacement risers is less than the original tread overhang is as follows:

(1) Install the first set of shims against the lower-most original riser; preferably a lower shim is braced against the lower landing and an upper shim is braced against the lower surface of the lower-most original tread, the shims sized to locate a replacement riser flush with the front of the lowermost original tread;

(2) Install the lowermost replacement riser with its cut edge (if Step 1 requires cutting the replacement riser) up adjacent the lower landing and the factory edge facing the lowermost original tread;

(3) Install the lowermost replacement tread first, using full coverage construction adhesive between the replacement tread and the original tread;

(4) Secure the lowermost replacement tread by nailing or fastening the back edge of the replacement tread to the original tread, preferably locating the nails or fasteners to be hidden by the replacement riser so as not to be visible when installation is completed);

(5) Install the next set of shims; preferably a lower shim is braced against the upper surface of the replacement tread and an upper shim is braced against the lower surface of the adjacent upper original tread (but a different shimming arrangement can be used depending on the relative height and thickness of the replacement risers);

(6) Install the next replacement riser with its cut edge (if Step 1 requires cutting the replacement riser) up adjacent the lower surface of the adjacent upper original tread and the factory edge against the replacement tread);

(7) Continue up the stairs, refacing each next upper original tread and original riser) as described in steps (4)-(6); and (8) Trim the topmost replacement tread if necessary to match up with carpeting, flooring, or the like installed on the upper landing.

In alternative embodiments of the method the shims can be attached first to the replacement risers so that the steps of installing the shims against the original riser and installing the replacement riser against the shims are performed substantially simultaneously.

While we have illustrated and described a preferred embodiment, it is understood that this is capable of modification, and we therefore do not wish to be limited to the precise details set forth, but desire to avail ourselves of such changes and alterations as fall within the purview of the following claims.

What we claim as our invention is:

1. A method of refacing a staircase, the staircase having an original tread that overhangs an original riser by a first horizontal distance $d_1$, the method comprising the steps of:

(a) placing a replacement tread on top of the original tread, the replacement tread extending from the original riser and overhanging the original riser by a second horizontal distance $d_2$;

(b) placing one or more shims directly against the original riser; and (c) installing a replacement riser against the one or more shims placed against the original riser, the replacement riser extending vertically and having a horizontal thickness t, the thickness t less than the distance $d_2$, the one or more shims spacing the replacement riser from the original riser a distance equal to the distance ($d_2$−t).

2. The method of claim 1 wherein $d_1=d_2$.

3. The method of claim 1 wherein step (b) is performed prior to step (c).

4. The method of claim 1 wherein steps (b) and (c) are performed essentially simultaneously.

5. The method of claim 1 including the step of fastening with fasteners the replacement tread adjacent to the original riser to the original tread, the fasteners spaced a horizontal distance not greater than $d_2$ from the original riser.

6. The method of claim 1 wherein the distance $d_1$ is between three-quarters of an inch and one and one-half inches.

7. The method of claim 1 wherein the distance $d_2$ is between three-quarters of an inch and one and one-half inches.

8. The method of claim 1 wherein the staircase comprises multiple original treads and original risers extending between an upper landing and a lower landing, the original risers extending between respective adjacent pairs of original treads, wherein steps (a)-(c) are performed to reface each original tread and the original riser extending between the original tread and the next adjacent original tread.

9. The method of claim 8 wherein the original treads include a first original tread immediately adjacent the lower landing and a second original tread adjacent to the first original tread, wherein the replacement tread placed on top of the first original tread is less thick than the replacement tread placed on top of the second original tread.

10. The method of claim 1 wherein the replacement tread has a front end that overhangs the original tread, the replacement tread comprising a scotia having a vertical face spaced the distance $d_2$ from the front end.

11. The method of claim 10 wherein the scotia partially overlaps the replacement riser after performing steps (a)-(c).

* * * * *